United States Patent [19]

Rodriguez et al.

[11] Patent Number: 4,927,524

[45] Date of Patent: May 22, 1990

[54] PROCESS FOR REMOVING VANADIUM AND SULPHUR DURING THE COKING OF A HYDROCARBON FEED

[75] Inventors: Domingo Rodriguez, Edo Miranda; Cebers Gomez, San Antonio de los Altos, both of Venezuela

[73] Assignee: Intevep, S.A., Caracas, Venezuela

[21] Appl. No.: 350,122

[22] Filed: May 10, 1989

[51] Int. Cl.[5] ..... C10G 9/14

[52] U.S. Cl. ..... 208/131; 208/107; 208/106; 208/46

[58] Field of Search ..... 208/106, 107, 131

[56] References Cited

U.S. PATENT DOCUMENTS

| | | | |
|---|---|---|---|
| 3,130,146 | 4/1964 | Plaster | 208/106 |
| 3,173,852 | 3/1965 | Smith | 208/106 |
| 3,179,584 | 4/1965 | Hamner et al. | 208/106 |
| 3,707,459 | 12/1972 | Mason et al. | 208/107 |
| 4,040,946 | 8/1977 | Hayashi et al. | 208/131 |
| 4,049,538 | 9/1977 | Hayashi et al. | 208/131 |
| 4,051,014 | 9/1977 | Masologites | 208/131 |
| 4,060,478 | 11/1977 | Lang | 208/106 |
| 4,479,804 | 10/1984 | Chen et al. | 208/131 |
| 4,560,467 | 12/1985 | Stapp | 208/107 |
| 4,579,501 | 7/1985 | George | 208/131 |
| 4,661,240 | 4/1987 | Kenick et al. | 208/131 |

FOREIGN PATENT DOCUMENTS

| | | | |
|---|---|---|---|
| 2542843 | 4/1976 | Fed. Rep. of Germany | 208/131 |

*Primary Examiner*—Helane Myers

*Attorney, Agent, or Firm*—Bachman & LaPointe

[57] ABSTRACT

A process for producing metallurgical coke from a hydrocarbon residuum characterized by high vanadium and high sulphur contents comprises coking a hydrocarbon residuum in a coking drum in the presence of an additive selected from the group consisting of carbonates and hydroxides of sodium, potassium and calcium and mixtures thereof and an oxidizing agent selected from the group consisting of water, carbon dioxide and mixtures thereof.

6 Claims, 1 Drawing Sheet

BLOCK DIAGRAM OF THE PROCESS

BLOCK DIAGRAM OF THE PROCESS

PROCESS FOR REMOVING VANADIUM AND SULPHUR DURING THE COKING OF A HYDROCARBON FEED

BACKGROUND OF THE INVENTION

The present invention is drawn to a process for producing metallurgical grade coke from a hydrocarbon residuum characterized by high vanadium and sulphur contents during the coking of the hydrocarbon residuum.

When treating a coker feed characterized by high vanadium and sulphur contents in a coking drum, the resultant coke, having vanadium concentration, is not suitable for making anodes for use in, for example, the production of aluminum. In order to upgrade the coke so that is suitable for the manufacture of anode, it is necessary to remove the excess vanadium and sulphur from the coke. The prior art is replete with processes which to one degree or another remove vanadium either from the coker feed or from the resultant coking drum product. Heretofore, there has been no process available which substantially removes all the vanadium and sulphur during the actual coking operation. Naturally, it would be highly desirable to provide a process for producing metallurgical grade coke from a hydrocarbon residuum characterized by high vanadium and sulphur contents during the coking of the hydrocarbon residuum.

Accordingly, it is the principal object of the present invention to provide a process for producing metallurgical grade coke from a coker to feed characterized by high vanadium and sulphur contents.

It is a particular object of the present invention to provide a process for producing metallurgical grade coke wherein vanadium and sulphur is removed during the actual coking operation.

It is a further object of the present invention to provide a process for producing metallurgical grade coke wherein vanadium can be recovered as vanadium pentoxide.

Further objects and advantages of the present invention will appear hereinbelow.

SUMMARY OF THE INVENTION

In accordance with the present invention the foregoing objects and advantages are readily obtained.

The present invention relates to a process for producing metallurgical grade coke from a hydrocarbon residuum used as a coker feed which is characterized by high vanadium and high sulphur contents. The crude oils found in the Orinoco oil belt region of Venezuela are generally characterized by high gravities; high pour points; high viscosities ad high metal and sulphur contents. When using residuums of these crudes as coker feedstocks the resultant coke is generally too high in vanadium and sulphur to be used as metallurgical coke for, as an example, anodes used in the production of aluminum. The process of the present invention allows for the economic upgrading of the coke product resulting from these coker feeds having high vanadium and sulphur contents so that the product is of metallugical grade.

The process of the present invention comprises feeding the hydrocarbon residuum characterzied by high vanadium and sulphur contents to a coking drum. A salt forming additive selected from the group consisting of carbonates and hydroxides of sodium, potassium, calcium and mixtures thereof and an oxidizing agent selected from the group consisting of water, carbon dioxide and mixtures thereof are fed to the coking drum. The feedstock, additive and oxidizing agent are thereafter heated in the coking drum so that the vanadium is oxidized to its pentavalent state thereby reacting with the additive so as to form a water soluble salt. At the same time, the sulphur reacts with the additive to form a water soluble salt. During the coking operation the feedstock decompses leaving a mass of coke. Superheated steam is injected into the coking durm so as to hydrolyze the sulphur. The coke is thereafter washed with water in the coking drum wherein the water soluble salts of vanadium and sulphur are forced into solution. The coke, now free of vanadium and sulphur and of metallurgical grade, is separated out from the solution. In accordance with a further feature of the present invention, vanadium pentoxide can be recovered be adjusting the pH of the solution with an acid such as for example hydrochloric acid. a carbonate of the additive can be regenerated by bubbling $CO_2$ gas through the solution. The resulting carbonate can then be recycled to the coking drum. Thus, by way of the present invention, an economical and efficient process for removing vanadium and sulphur is developed so as to produce metallurgical grade coke.

DETAILED DESCRIPTION

Figure 1:
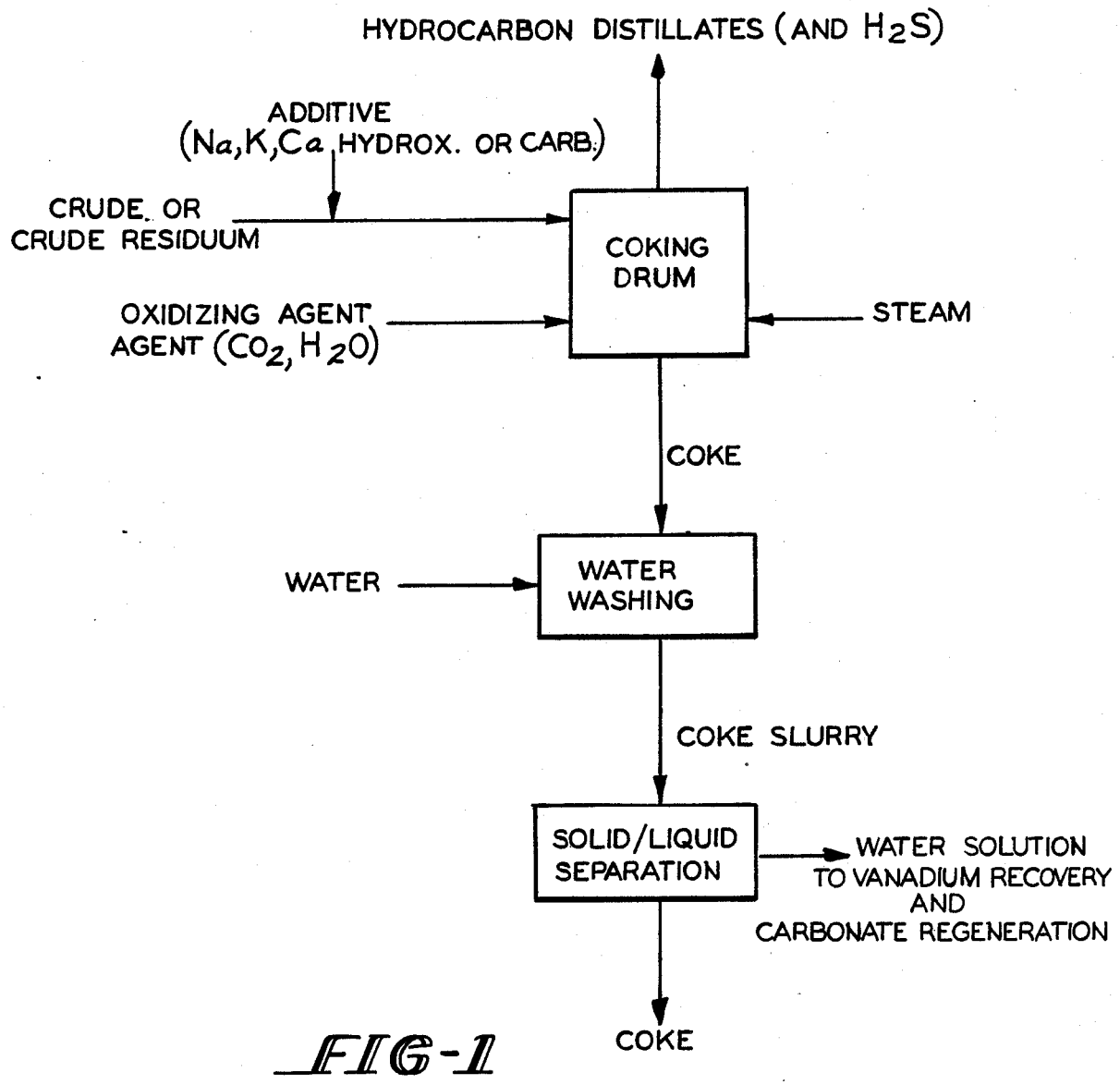
FIG. 1 shows a block diagram of the process of the present invention.

In accordance with the present invention, the process for the removal of vanadium and sulphur from a coker feedstock is based on a number of chemical reactions which take place within the coking drum during the coking of the feedstock. In accordance with the present invention, the feedstock is fed to the coking drum along with an oxidizing agent selected from the group consisting of water and carbon dioxide and mixtures thereof along with an additive selected from the group consisting o carbonates and hydroxides of sodium, potassium and calcium and mixtures thereof. The oxidizing agent is added in an amount equal to about between 1% and 15% by weight with respect to the total weight of the feedstock. The additive is added in an amount of about between 1% and 15% by weight with respect to the total weight of the feedstock. The feedstock, additive and oxidizing agent are thereafter heated in the coking drum so as to decompose the feedstock to form coke. In accordance with the present invention, the coking drum is heated to a temperature of between 300° to 450° C. at a pressure of between 20 to 2000 psi for a time of about 20 to 120 minutes.

During the heating and coking of the feedstock, the first relevant chemical reaction is the oxidation of the vanadium in the feedstock to its pentavalent state. It is necessary to oxidize the vanadium to its pentavalent state in order for the vanadium to react with the additive material. In order to oxidize the vanadium to its pentavalent state the water or carbon dioxide or mixtures thereof must be in the coking drum during the coking operation. The vanadium, present in the feedstock in its trivalent or tetravalent states, reacts with the water and/or $CO_2$ gas and is oxidized to its pentavalent state. The reaction is shown hereinbelow.

$$V^{+3,+4} + \begin{matrix} OH^- \\ CO_2 \\ H_2O \end{matrix} > V^{+5} + \begin{matrix} CO \\ \\ H_2 \end{matrix}$$

Once the vanadium is oxidized to its pentavalent state. the vanadium reacts with the additive, for example sodium hydroxide, so as to form a water soluble salt. The chemical reaction is as follows.

ti $Na^+ + 30^= + V^{+5} \ldots NaVo_3$ (s)

At the same time, a reaction takes place between the sulphur and the additive compound resulting in the formation of a water soluble sulphur salt by way of the following reaction.

$$2Na^+ + S^= \ldots Na_2S$$

After the coking drum is heated so as to oxidize the vanadium to its pentavalent state, and the vanadium and the sulphur react with the additive to form water soluble salts of vanadium and sulphur, respectively, the sulphur compound is hydrolyzed by injecting superheated steam into the drum so as to form $H_2S$ in accordance with the following reaction.

$$Na_2S(s) + H_2O(g) \ldots Ha_2O + H_2S(g)$$

The $H_2S$ gas is removed form the coking drum. The resulting coke from the coking operation is thereafter washed with water therein the salts are passed into solution in accordance with the following reactions.

$$NaVO_3 + H_2O \ldots Na^+ + VO_2 + 20H^-$$

$$Na_2O + H_2O \ldots 2Na^+ + 20H^-$$

The coke, substantially free of vanadium and sulphur can then be separated from the solution and used for whatever purpose desired.

Vanadium can the be recovered from the resulting solution as vanadium pentoxide ($V_2O_5$) by adjusting the pH of the solution with, for example, hydrochloric acid to a pH of 2. In addition, the additive can be regenerated and recycled to the coking drum by bubbling $CO_2$ through the aqueous solution in an amount of about between 0.5 to 2.0 liters per gram of additive added wherein, in the case of sodium, sodium carbonate is regenerated by the following reaction.

$$2\ Na^+(aq) + CO_2(g) \ldots Na_2CO_3(s)$$

FIG. 1 shows a block diagram of the process of the present invention.

The following examples are given to illustrate the process of the present invention and it should be understood that these examples are not intended to limit the generally broad scope of the present invention.

EXAMPLE 1

In order to determine the compounds formed during the coking operation in accordance with the process of the present invention, a Boscan crude having the composition and properties set forth below in Table I was mixed with 7% by weight NaOH with reference to the total weight of the crude.

TABLE I

| BOSCAN CRUDE PROPERTIES | |
|---|---|
| API Gravity: | 10.1 (°API) |
| Specific Gravity (60/60): | 0.999 |
| Viscosity (140° F.): | 1832 (cs) |
| Pour Point: | +60(°F.) |
| Ultimate Analysis (wt. %, dry basis) | |
| Carbon: | — |
| Hydrogen: | — |
| Sulphur: | 5.66 |
| Nitrogen: | 0.44 |
| Ash: | — |
| Metal Content (ppm) | |
| Vanadium: | 1220 |
| Nickel: | 250 |

The mixture was then reacted under the following coking conditions: Temperature, 450° C.; Pressure, 500 psi with $CO_2$; Time, 30 minutes. The resulting coke product was subject to X-ray analysis. The following water soluble compounds of sodium-sulphur and sodium-vanadium were identified.

$$Na_2S \quad \begin{matrix} Na\ 3VO_4 \\ Na_2O.X\ V_2O_4.(6\text{-}X)\ V_2O_5 \\ Na_4\ V_2O_7 \end{matrix}$$

Thus, it can be seen that the vanadium and sulphur in the feedstock reacts with the additive to form water soluble salts.

EXAMPLE 2

In order to demostrate the effectiveness of additives of sodium carbonate and sodium hydroxide as additives for the desulphurization and demetallization of petroleum coke, five (5) comparative test were run using the Boscan crude of Example 1 and Cerro negro crude having the composition and properties set forth below in Table II.

TABLE II

| CERRO NEGRO CRUDE PROPERTIES | |
|---|---|
| API Gravity: | 8.3 (°API) |
| Specific Gravity (60/60): | 1.0122 |
| Viscosity (140° F.): | 5.66 (cs) |
| Ultimate Analysis (wt. %, dry basis) | |
| Carbon: | 83.87 |
| Hydrogen: | 10.50 |
| Sulphur: | 3.81 |
| Nitrogen: | 0.70 |
| Oxygen: | 1.07 |
| Ash: | 0.05 |
| Metals (ppm) | |
| Vanadium: | 507 |
| Nickel: | 118 |
| Sodium: | 97 |

In test 1 20% by weight sodium hydroxide was mixed with the Cerro Negro crude. In test 2 7% by weight sodium hydroxide was mixed with the Boscan crude. In Test 3, 4, and 5 sodium carbonate was mixed with the Cerro Negro crude in an amount of 10%, 15% and 25% by weight, respectively. All the tests were run under the following reaction conditions: Temperature, 450° C.; Pressure, 500 psi with $CO_2$: Time, 30 minutes. The resultant coke was washed with water at 90° C. for 8 haours. Table III summarizes the desulphurization and demetallization achieved.

TABLE III

| TEST | ADDITIVE | % OF ADDITIVE | DESULPHURIZATION | DEMETALLIZATION |
|---|---|---|---|---|
| 1 | NaOH | 20 | 73 | 32 |
| 2 | NaOH | 7 | 43 | 18 |
| 3 | $Na_2Co_3$ | 10 | 5 | 9 |
| 4 | $Na_2Co_3$ | 15 | 3 | 8 |
| 5 | $Na_2Co_3$ | 25 | 4 | 29 |

As can be seen from Table III the use of sodium hydroxide reduced the levels of vanadium by as much as 73% and of sulphur by as much as 32% while sodium carbonate achieved 5% demetallization and 9% desulphurization.

EXAMPLE 3

In order to compare the yields from coking with without the additive to the present invention a charge of Cerro Negro was subjected to a coking operation and compared to a charge mixed with 5% by weight sodium hydroxide with respect to the Cerro Negro. The reaction condition for both charges were the same as for Examples 1 or 2, above. Table IV shows the comparison of the yields of Cerro Negro with and without the additive as well as the levels of desulphurization and demetallization of the coke.

TABLE IV

| CHARGE | RESIDUE 260° C.+ (Without) | RESIDUE 260° C.+ (With) |
|---|---|---|
| Additive (NaOH), g | — | 5 |
| Operating Pressure, kPa | 308.1 | 308.1 |
| Yield, % of the Charge | | |
| to the Coker | | |
| $C_2 + H_2S$ | 8.5 | 6.8 |
| LPG ($C_3$ and $C_4$) | 2.5 | 2.4 |
| Naphtha ($C_5$-210° C.) | 16.7 | 19.0 |
| LGO (210–345° C.) | 24.0 | 21.4 |
| HGO (345–468° C.) | 24.4 | 29.8 |
| Coke | 23.9 | 20.0 |
| Total | | |
| Properties of the coke | | |
| Sulphur, % | 4.7 | 3.15 |
| Desulphurization, % | — | 33.0 |
| Vanadium, ppm | 1550 | 1270 |
| Demetallization, % | — | 11.6 |

As can be seen from Table V, the use of sodium hydroxide as an additive increased the yields of liquid products and reduced those of coke the gases. In addition, the level of sulphur in the coke was reduced by 33% while the meals level fell 11.6%.

As can be seen from the foregoing examples, the process of the present invention is an effective method for removing vandium and sulphur so as to produce metallurgical grade coke.

This invention may be embodied in other forms or carried out in other ways without departing form the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for producing metallurgical grade coke from a hydrocarbon feedstock characterized by high vanadium and sulphur contents comprising:

(a) feeding said hydrocarbon feedstock to a coking drum;

(b) feeding an additive selected from the group consisting of carbonates and hydroxides of Na, K, Ca and mixtures thereof to said coking drum;

(c) feeding an oxidizing agent to said coking drum;

(d) heating said feedstock, said additive and said oxidizing agent in said coking drum such that said vanadium is oxidized to its pentavalent state so that said vanadium reacts with said additive so as to form a water soluble salt while at the same time said sulphur reacts with said additive so as to form a water soluble salt and said feedstock decompses leaving a mass of coke;

(e) injecting superheated steam into said coking drum so as to hydrolyze said sulphur to form $H_2S$;

(f) washing said coke with water wherein said water soluble salts are forced into solution; and (g) separating out said coke substantially free of vanadium and sulphur from said solution.

2. A process according to claim 1 wherein said additive is fed to said coking drum in an amount of about 1 to 15 wt. % with respect to said feedstock.

3. A process according to claim 1 wherein said oxidizing agent is fed to said coking drum in an amount of about 1 to 15 wt. % with respect to said feedstock.

4. A process according to claim 1 wherein said feedstock, additive, and oxidizing agent are heated to a temperature of about between 300° and 450° C. at a pressure of about between 200 and 2000 psi.

5. A process according to claim 1 wherein said oxidizing agent is selected from the group consisting of $H_2O$, $CO_2$ and mixtures thereof.

6. A process according to claim 1 including bubbling $CO_2$ through said solution in an amount of between 0.5 to 2.0 liters per gram of additive added so as to form a carbonate of said additive.

* * * * *